United States Patent [19]

Borglund

[11] Patent Number: 4,930,968

[45] Date of Patent: Jun. 5, 1990

[54] METHOD AND APPARATUS FOR EMPTYING PACKAGES, ESPECIALLY BAGS

[76] Inventor: Tomas Borglund, Sandgatan 6, S-260 40 Viken, Sweden

[21] Appl. No.: 303,727

[22] PCT Filed: Jul. 16, 1987

[86] PCT No.: PCT/SE87/00338

§ 371 Date: Jan. 23, 1989

§ 102(e) Date: Jan. 23, 1989

[87] PCT Pub. No.: WO88/00908

PCT Pub. Date: Feb. 11, 1988

[30] Foreign Application Priority Data

Jul. 28, 1986 [SE] Sweden ..... 8603231

[51] Int. Cl.[5] ..... B65B 69/00; B65G 65/24

[52] U.S. Cl. ..... 414/412; 198/675; 198/676; 414/786

[58] Field of Search ..... 414/412, 786, 291, 326, 414/502, 526; 198/675, 676; 209/3; 100/145-150, 65, 98 R, 94

[56] References Cited

U.S. PATENT DOCUMENTS

| | | | |
|---|---|---|---|
| 3,580,389 | 5/1971 | Donnenmacher | 198/675 X |
| 3,812,985 | 5/1974 | Lindeborg et al. | 414/526 |
| 3,939,998 | 2/1976 | Soltermann | 414/412 X |
| 4,181,461 | 1/1980 | Bernicot | 414/412 |
| 4,182,592 | 1/1980 | Henryson | 414/412 |
| 4,252,489 | 2/1981 | Mechalas | 414/412 |
| 4,274,787 | 6/1981 | Mueller et al. | 414/412 |
| 4,278,384 | 7/1981 | Marchesini | 414/412 |
| 4,408,947 | 10/1983 | Lenski et al. | 414/526 |
| 4,441,603 | 4/1984 | Baumard | 198/676 X |
| 4,627,781 | 12/1986 | Borgner | 414/291 X |

*Primary Examiner*—David A. Bucci

*Attorney, Agent, or Firm*—Brooks & Kushman

[57] ABSTRACT

A method and an apparatus for emptying packages, especially bags, of their contents is described. The bags are introduced through a casing (2) to a rotatable cutting, tumbling and feeding screw (4) for cutting, the contents of the cut bags (54) being removed through perforations (28) in the casing or wall portions (6) associated therewith. Separation is achieved by rotating the screw (4) in a first direction (B) for advancing the cut bags (54) to an end wall (6) of the casing (2) adjacent a rear end (62) of the screw where the bags are caused to tumble about within the casing (2) under the action of the screw rear end rotating in said first direction (B), for separating the contents from the cut bags (54). After the separation at the screw rear end has been concluded, the screw (4) is rotated in a second direction (F) for advancing the emptied bags (33) in a direction toward the screw front end to a bag discharge opening (36) which is provided in the casing (2) and through which the emptied bags (33) are discharged from the casing (2).

11 Claims, 6 Drawing Sheets

46
26
2
52
28
48
48
32
50
50
30
50
50

METHOD AND APPARATUS FOR EMPTYING PACKAGES, ESPECIALLY BAGS

TECHNICAL FIELD

The present invention relates to a method and an apparatus for emptying packages, especially bags, of their contents by means of a cutting and feeding screw which is rotatably mounted within a casing and to which the bags are supplied for cutting through a peripheral opening in the casing, the contents separated from the cut bags being removed through perforations or the like provided in the casing or adjacent wall portions.

Even though the invention is especially useful for, and will be explained herein in connection with, the emptying of bags, it will be appreciated that what has been said below with reference to bags is applicable also to other types of packages, such as cartons etc.

BACKGROUND ART

Prior art bag emptying apparatuses of this type are disclosed in, for example, Ser. No. 421,063, Ser. No. 402,574, Ser. No. 404,170 and U.S. Pat. No. 4,181,461 and comprise, in principle, a receiving unit into which unopened bags are supplied manually or otherwise and in which a first cutting of the bags may occur, a cutting and feeding unit in the form of a horizontal screw conveyor having a casing and a cutting and feeding screw rotatably mounted therein for cutting the bags supplied into the receiving unit and for horizontally feeding the cut bags, and a separating unit connected to the discharge end of the screw and adapted to separate the contents from the bags cut by the screw.

In the prior art apparatuses according to the above-mentioned patent specifications, the bottom of the screw conveyor casing is provided with perforations or the like for removing from the casing any material which, during the cutting and transport by means of the screw, spills from the but bags onto the bottom of the casing while the bags are being conveyed toward the discharge end of the casing. However, although some material thus is separated within the cutting and feeding screw conveyor, the actual separation of the contents from the cut bags occurs according to prior art technique in the said separating unit which, in the above-mentioned patent specifications, is a relatively large cylindrical screening drum, the entrance end of which is connected to the discharge end of the screw conveyor for receiving the bags cut by the screw, and the opposite end of which is open for discharging emptied bags. To effect the separation within the screening drum, the drum is rotatably mounted about its geometrical axis and provided throughout its circumference with perforations or the like. To advance the cut bags through the screening drum during the separation therein, the axis of rotation of the drum may be slightly inclined toward the horizontal plane, or the screening drum may be provided on its inner circumference with blades or the like for advancing the bags as these are being tumbled about in the screening drum.

The contents separated from the bags are collected conventionally underneath the screening drum and/or the casing, and the emptied bags are discharged at the other end of the screening drum for collection, optionally for compaction in a separate collecting receptacle.

A bag emptying apparatus of the type described above has a number of disadvantages. Because complete separation requires both a screw conveyor and a separate screening drum having a relatively large diameter, the apparatus will be bulky and complicated. If, in addition, compaction of the emptied bags is desired, a separate compacting unit must be provided for this purpose at the discharge end of the screening drum, which further increases the size of the apparatus and makes its construction more complicated and costly. The considerable dimension and cost of a bag emptying apparatus of the type described implies that such an apparatus can be economically operated only by users who have frequent use for rapid emptying of many bags at a time. For users who have less frequent use for bag emptying and to whom the emptying time is not of decisive importance, these known apparatuses are not economic, for which reason the bags in this instance often are emptied manually. Furthermore, the use of a large screening drum frequently causes environmental pollution by the dust it raises.

When the material is discharged through the perforations in the screw conveyor casing and through the circumference of the screening drum, means are required for collecting the discharged material at one and the same location, which further contributes to increasing the cost and dimension of the apparatus.

SUMMARY OF INVENTION

It is the object of the present invention to obviate the above-mentioned disadvantages of prior art bag emptying apparatuses.

More particularly, it is the object of the invention to provide a method and an arrangement which make it possible to design an inexpensive, simple and compact bag-emptying apparatus in which the bags are cut, emptied, conveyed and compacted within a highly restricted space as compared with prior art bag-emptying apparatuses.

To achieve this object, the invention utilizes but a single screw for carrying all of the above-mentioned steps into effect.

The basic idea of the present invention is to rotate the screw in different directions during an emptying step and a discharging/compacting step. More particularly, the screw is first rotated in a first direction (hereinafter called the reversing direction), after the bags have been cut in known manner by the screw, to feed the cut bags toward a rear end of the screw to a radial end wall arranged at the screw rear end and connecting onto a casing surrounding the screw. When the cut bags have been advanced to this inner end wall of the casing by the screw rotation in the reversing direction, the screw end causes the bags to tumble about within the casing at said radial end wall, whereby a highly efficient emptying of the bags is achieved in that the bags frequently change their position in relation to the screw and the casing, which is achieved without necessitating the use of a separate screening drum or the like. The contents separated in this manner from the bags are discharged in per se known manner through perforations or the like in the casing bottom or the adjacent wall portions. By "tumbling about" is here meant (a) that the bag is caused to rotate about the screw proper, or (b) that the bag is caused to turn about its own axis, or (c) a combination of movements (a) and (b).

To improve the separating effect during emptying at the said radial end wall, the screw may optionally be reversed repeatedly during shorter periods of time, such that the bags are moved back and forth repeatedly within the casing, whereby the change in bag position relative to the screw is further promoted.

To prevent the bags from being wedged between the screw flight and the rear end wall during the separation, the screw preferably is formed at its rear end in a novel manner.

After the cut bags have been completely emptied by the above-mentioned tumbling motion at the screw rear end, optionally in combination with the said repeated short reversing of the screw, the direction of the screw rotation is reversed, in accordance with the basic idea of the invention, to advance the emptied bags toward the screw front end to a bag discharge opening in the casing, through which emptied bags are discharged.

The advance of the emptied bags in the axial direction away from the end wall is promoted if the screw rear end is formed in the manner described in this embodiment.

The emptied bags which, according to the invention are advanced toward the screw front end by reversing the direction of screw rotation, are discharged, in accordance with a preferred embodiment of the invention, through a bag discharge opening coinciding with vertical plane and provided in the front end of the casing, the emptied bags being collected in a receptacle connected with the bag discharge opening, for example a plastic bag or the like which is passed over the front end of the casing at the said opening. By rotating the screw in the forward direction, the emptied bags will thus be discharged into the said receptacle.

According to the invention, means are provided adjacent the bag discharge opening to prevent emptied bags already discharged into the receptacle from being returned into the casing during emptying of the next bag/-bags when the screw is rotated in the reversing direction.

Without such means, the bags compacted in the receptacle would, upon attainment of a given filling and compacting degree in the receptacle, counteract the introduction of further emptied bags into the receptacle and urge these bags back toward the forward end of the screw, and as a result the bags last emptied would be reintroduced, at the bag discharge opening, into the screw when the latter is reversed during emptying of the next bag.

In an embodiment especially preferred according to the present invention, the means for preventing reintroduction of the bags are constituted by additional screw blade portions acting in the manner of a non-return valve and preventing reintroduction of emptied bags that have already been discharged and compacted in the receptacle. The details of the design of these additional screw blade portions at the front discharge end of the screw are defined by this embodiment. According to this embodiment, the screw blade, at a point on its last turn at the screw front end, branches into an inner and an outer screw blade portion.

The first and inner screw blade portion basically is an extension of the "ordinary" screw blade that ends in a radial end edge axially spaced from the front end edge of the screw shaft. The second and outer screw blade portion has a higher pitch and also a shorter circumferential extent than the inner screw blade portion. The outer screw blade portion which constitutes an extension of the front feeding surface of the screw blade at the said branching point, extends all the way up to the front end edge of the screw shaft where the outer screw blade portion connects onto a third screw blade portion having an opposite or negative pitch as compared with the remaining screw blade portions. Said third negative-pitch screw blade portion extends from the transition to the outer screw blade portion up to the above-mentioned radial end edge of the inner screw blade portion. In an embodiment, chosen by way of example, of this screw blade design at the screw front end, the inner screw blade portion extends circumferentially through about 270°, the outer screw blade portion extends circumferentially through about 180°, and the third screw blade portion extends through about 90°.

The above-mentioned design of the screw front end thus provides a bag discharge gap which is defined on the one hand by the radial connecting line between the end edge of the inner screw blade portion and the end edge of the third screw blade portion and, on the other hand, by the opposite front feeding surface of the screw blade 360° nearer to the screw rear end. When the screw for discharging the emptied bags is rotated in the forward direction, the emptied bags will thus first be discharged through said discharge gap and then, under the action of the front feeding surface of the outer screw blade portion, will be squeezed out and compacted in the collecting receptacle.

The third screw blade portion prevents the emptied bags from being reintroduced into the screw as this is being rotated in the reversing direction during the emptying and separation at the screw rear end since this third screw blade portion, because of its negative pitch, exerts a discharging force on the emptied bags in the receptacle when the screw is rotated in the reversing direction. Since paper bags and the like reexpand relatively slowly after compression or compaction, any emptied bags pressed into the receptacle by the third screw blade portion will not have time to expand sufficiently to be caught in the said discharge gap during rotation of the screw in the reversing direction.

The transition at the screw shaft front end between the feeding surface of the outer screw blade portion and the feeding surface of the third screw blade portion preferably is made pointed in the form of a radial V-shaped edge which, during rotation of the screw, will promote uniform circumferential distribution of the emptied bags introduced into the collecting receptacle adjacent the screw, regardless of the direction of screw rotation.

To sum up, the proposed invention thus makes it possible to cut, convey and completely empty bags and compact emptied bags by means of one and the same screw and within a highly restricted space, which should be compared with the prior art arrangement referred to in the introduction and comprising a separate cutting and feeding unit, a separate screening drum or the like, and a separate compacting unit. Since the invention requires no screening drum and no separate compacting unit, a bag emptying apparatus designed in accordance with the present invention will also be congenial to the environment and simple in operation.

It should be pointed out, however, that the special non-return valve arrangement of the screw front discharge end is necessary only if a counterpressure prevails in the bag discharge opening of the casing. In other embodiments of the invention, the bag discharge opening may be provided, for example, in the casing bottom through which the emptied bags are allowed to drop by gravity into a collecting receptacle.

Nor is the special design of the screw rear end an absolute requirement for the construction according to the invention. If a sufficiently powerful driving motor is used for rotating a "normal" screw, any wedging forces between the screw blade and the inner end wall of the casing will be surmounted by the motor torque.

The construction and mode of operation of a preferred embodiment of a bag emptying apparatus according to the invention will now be described below, reference being had to the accompanying drawings.

BEST MODE FOR CARRYING OUT THE INVENTION

Figure 1:
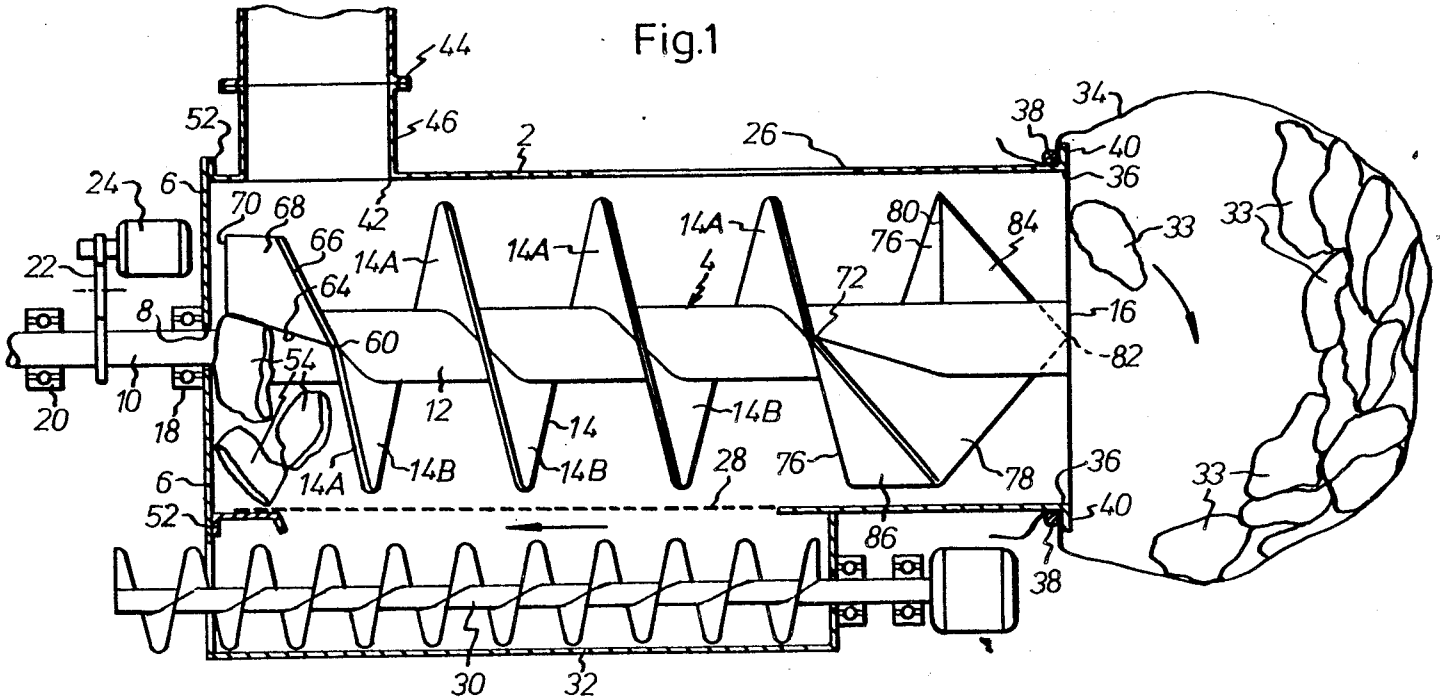
FIG. 1 is a schematic longitudinal section of a bag emptying apparatus according to the invention, comprising a screw rotatably mounted within a casing.

The bag emptier according to the invention, as shown in FIG. 1, is especially intended for, and will be described in connection with, the emptying of one bag at a time, even though this is of no importance to the invention which may just as well be used for emptying several bags at the same time.

The one-bag emptier shown in FIG. 1 substantially comprises a horizontal screw conveyor having a horizontal elongate casing 2 and a cutting and conveying screw rotatably mounted therein and generally designated 4. The casing 2 is closed at its rear end by means of an end wall 6 having a central opening 8 for a drive shaft 10 for rotating the screw 4. The screw is provided, in known manner, with a screw shaft or centre tube 12 and a helical blade 14 mounted on said centre tube 12. In the embodiment illustrated, the screw 4 is self-supporting and suspended at its rear end facing the end wall 6. The drive shaft 10 which thus carries the entire screw, extends through the entire centre tube 12 up to the front end thereof where the drive shaft 10 and the tube 12 are mutually and fixedly interconnected by means of an end plate 16 (see also FIG. 3). A similar end plate (not shown) is provided also at the rear end of the centre tube 12 and fixedly interconnected with the drive shaft 10. At its other end, the drive shaft 10 is mounted in two bearings 18, 20 and is, via a transmission 22, operatively connected with an electric motor 24.

The casing 2 has in its upper side a bag infeed opening 26 through which the bags to be cut, emptied and compacted are introduced into the screw 4 one at a time. Furthermore, the casing 2 is provided in its bottom with a perforated panel 28 (see also FIG. 2) through which the contents separated from the bags are removed from the casing 2. The material falling through the perforations 28 is discharged from the apparatus in the horizontal direction underneath the casing 2 by means of a second feeding screw 30 rotatably mounted in a collecting trough 32 which preferably is sufficiently large to act as a buffer in order to prevent clogging by material on the upper side of the perforated panel 28.

To collect emptied bags 33 a collecting receptacle 34 which, in the embodiment illustrated, is a plastic bag, is stretched over the front open end of the casing 2, which forms a bag discharge opening 36. To hold the bag 34 in position, use is made, in the embodiment illustrated, of a rubber ring 38 engaging an outer flange 40 on the front end of the casing 2 and clamping the plastic bag 34 against the casing and the flange 40. The advantage of this clamping technique will be described in more detail below.

Furthermore, the casing 2 has at its rear end an upper opening 42 which serves, inter alia, for exhausting dust from the casing, the dust being deposited in a filter 44 which is carried by a stack-like pipe 46 connected to the opening 42.

Figure 2:
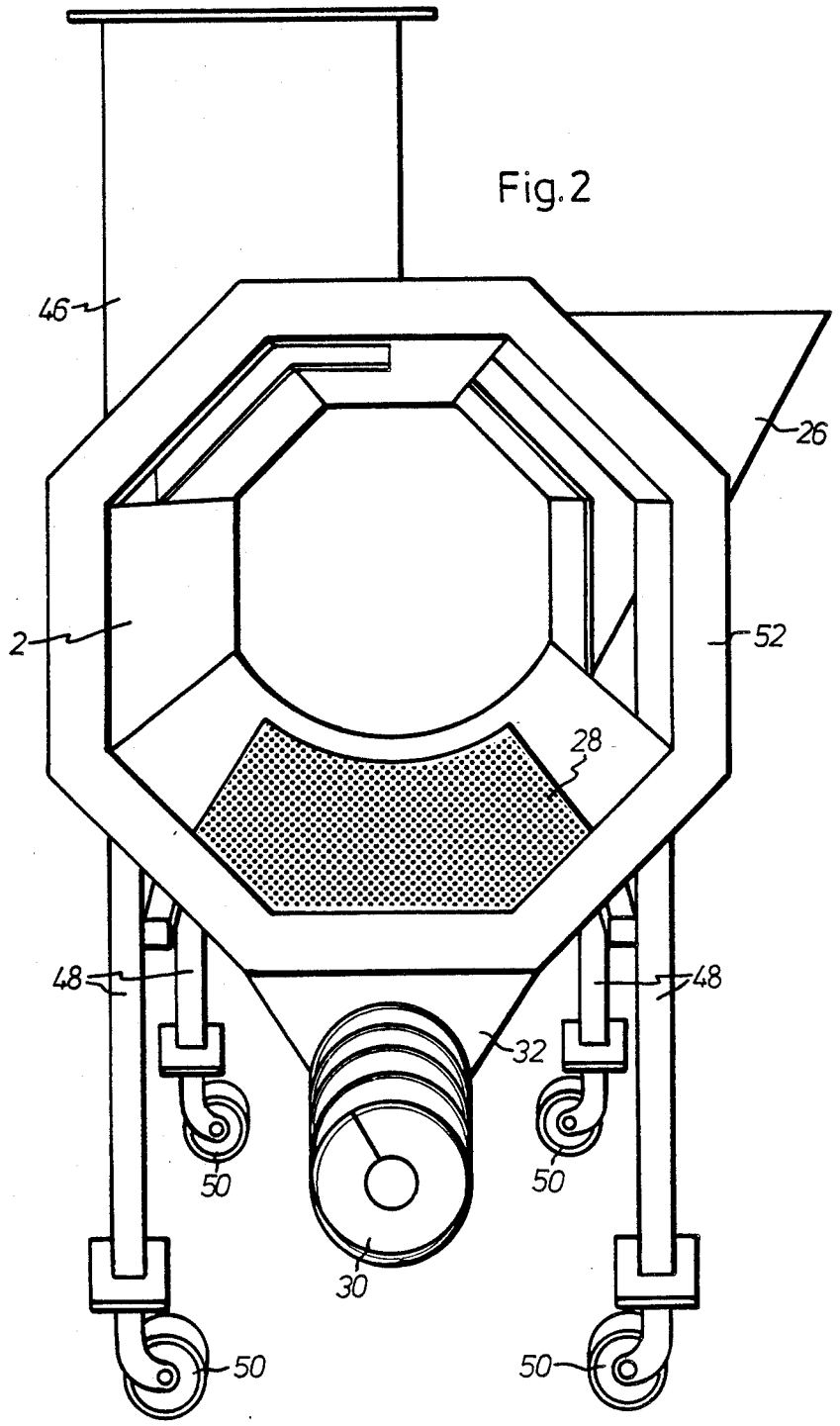
FIG. 2 is a perspective front view of the casing shown in FIG. 1, in which the screw has been removed to expose the internal parts of the casing.
Figure 3:
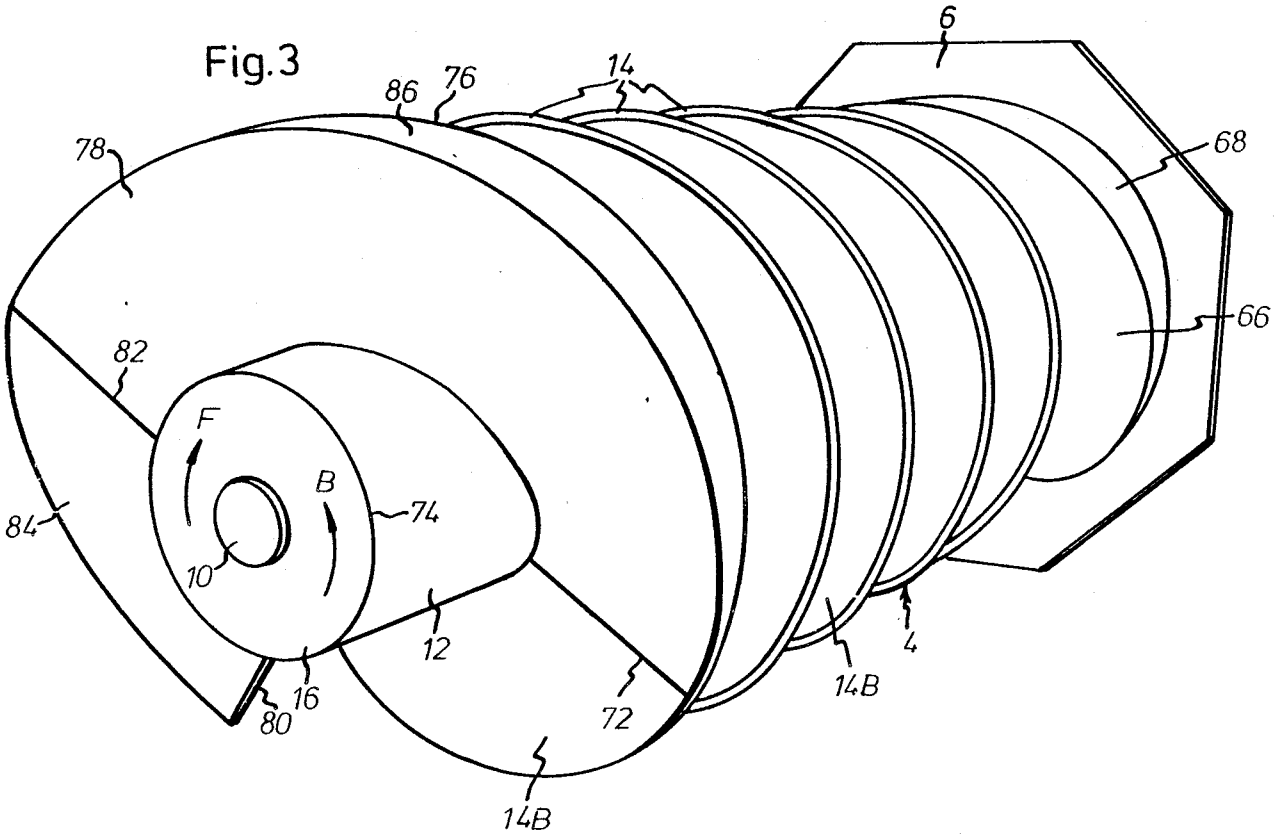
FIG. 3 is an oblique front perspective view of the exposed screw and of an end wall for connection to the casing.

As will appear from FIG. 2 which shows the casing 2 from its rear end and in which the screw 4, the end wall 6 and the driving means 10, 22, 24 have been removed, the casing 2 is carried by a frame 48 having wheels 50. FIG. 2 also shows an end flange 52 which is provided on the casing rear end and adapted to be connected with and to carry the end wall 6, the appearance of which is shown in FIG. 3.

The arrangement described with reference to FIGS. 1–3 functions and operates as follows. Initially, the casing 2 and the collecting receptacle 34 are empty. A bag which has as yet not been cut and contains, for example, cement, is placed in the infeed opening 26 and allowed to drop therethrough toward the peripheral edge of the screw blade 14. Rotation of the screw 4 can be initiated either before or after the bag has been introduced. In any case, the screw 4 is rotated in a first direction, hereinafter called the reversing direction, to feed the bag cut by the screw toward the end wall 6. The screw will cut the bag in known manner, optionally into several pieces, while the bag is being wedged between the screw 4 and the inner side of the casing 2. While the bag is being advanced from the inlet opening 26 along the bottom of the casing to the end wall 6, a part, but not all, of its contents will drop onto the casing bottom and through the perforated panel 28 down into the collecting trough 32.

When the cut bag has been advanced up to the rear end wall 6, the screw 4 is caused to continue its rotation in the reversing direction, which is one of the characteristic features of the invention. In this manner, the cut bag which in this position is designated 54, will tumble about in the casing against the end wall 6, whereby the contents of the cut bag 54 will be completely separated from the bag. Naturally, the degree of separation depends upon the total emptying time at the end wall 6, the bag size, and the degree to which the bag 54 has been cut and/or torn. The contents separated in this manner will drop onto the casing bottom or the perforated panel 28 and then drop down into the collecting trough 32 where they are discharged by the discharge screw 30.

For maximum emptying and separation efficiency, the screw 4 can be reversed one or more times while the bag is tumbling against the end wall 6. For example, by rotating the screw 4 through approximately 360° in the opposite direction, hereinafter called the forward direction, and then again in the reversing direction, the position of the bag or bag parts 54 in relation to the screw can be varied in an advantageous manner, which obviously improves the separation effect during the tumbling.

After the cut bag 54 has been completely emptied, the screw 4 is rotated in the forward direction for advancing the emptied bag toward the front end of the screw 4 and out through the bag discharge opening 36 where the remainder of the bag which is here designated 33 is collected in the receptacle 34.

Figure 4A:
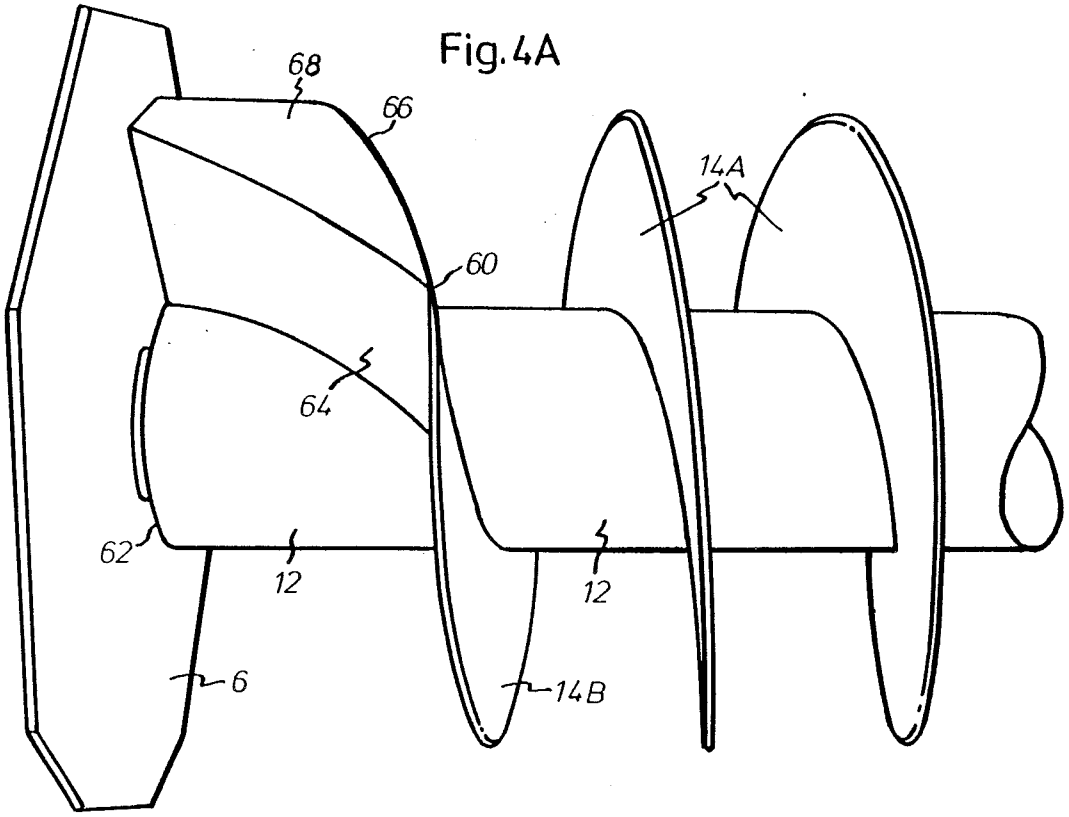
FIGS. 4A and 4B are lateral perspective views of a preferred embodiment of the screw rear end, the screw being shown in two different positions of rotation, and the screw front end being broken away.

A preferred embodiment of the screw rear end where tumbling and separation occur, will now be described in more detail, reference being had to FIGS. 4A and 4B which are lateral perspective views of the screw rear end in two different positions of rotation. As will be best seen from FIG. 4A, the screw blade 14 extends with its normal pitch up to a point 60 at an axial distance from the rear edge 62 of the centre tube 12, where the rear feeding surface 14A of the screw blade 14 passes into a guiding surface 64 formed by one surface of a piece of sheet metal projecting radially from said centre tube 12. The angle of inclination of the guide surface 64 in relation to the geometrical axis of the centre tube 12 is significantly smaller than the angle of inclination of the rear feeding surface 14A of the screw blade 14. From the transition 60 which, more particularly, is a radially extending joint, the guide surface 64 extends all the way up to the rear end edge 62 of the centre tube 12. In the embodiment illustrated, the rear end edge 62 lies at a small axial distance from the end wall 6 (see also FIG. 1).

Figure 4B:
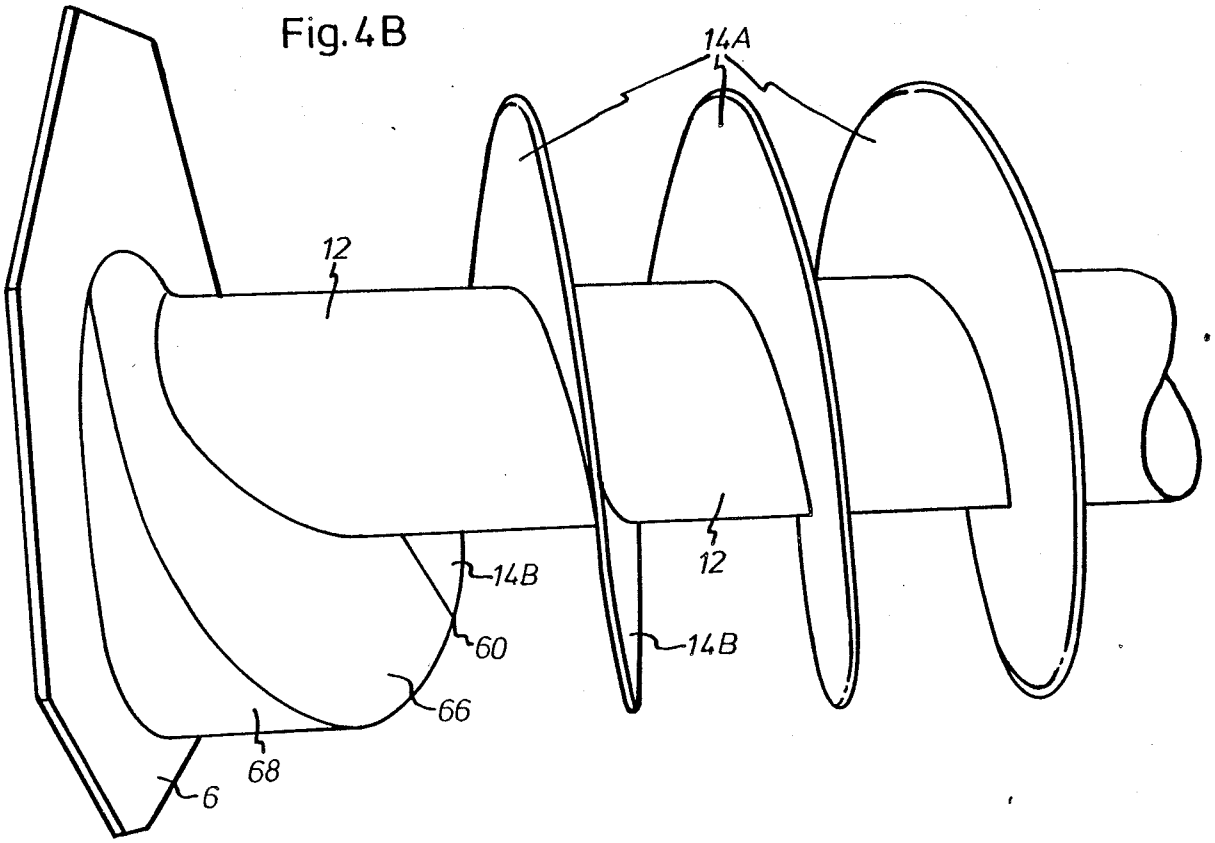

Moreover, the screw 4 is provided at its rear end with a screw blade end portion 66 which is an extension of the screw blade 14 from the transition 60 and extends circumferentially through approximately half a turn up to the rear end edge 62 of the centre tube 12, as is best seen from FIG. 4B. The feeding surface of the screw blade end portion 66 serves to promote the advance of emptied bags 54 away from the end wall 6 when the screw 4 is rotated in the forward direction. In the embodiment illustrated, the screw blade end portion 66 has a pitch which is approximately twice as large as the normal pitch of the screw blade 14, whereby a relatively large space is formed between the screw blade 14, the guide surface 64 and the end wall 6, in which space tumbling and separation of the emptied bags 54 occurs.

During the rotation of the bags 54, the abovementioned opening 42 contributes to the separation in a highly efficient manner, in that it promotes the variation in the bag position relative to the screw 4.

As mentioned above, neither the guide surface 64 nor the screw blade end portion 66 are actually needed for effecting the separation at the rear end wall 6. If a sufficiently powerful driving motor is used, the emptying method according to the invention may also be carried out with a "normal" screw blade having the same pitch all the way up to the rear end edge 62 of the centre tube 12. However, dispensing with the guide surface 64 or the screw blade end portion 66 means that there is a risk that the bag 54 during the separation may be wedged between the outermost screw blade portion and the end wall, and that the preferred large bag tumbling space will not be achieved.

Moreover, it is possible, as an alternative, to retain the guide surface 64 but to dispense with the screw blade end portion 66, in which case the other surface of the sheet metal piece forming the guide surface 64 will function as a front feeding surface during the removal of emptied bags from the end wall 6. However, the angle of inclination of this sheet metal piece is so large—because there must be no risk of wedging at the guide surface 64—that the feeding effect in the forward direction in this case will be insufficient.

To avoid that the cut bag 54 during the tumbling is introduced into the space between the guide plate 64 and the screw blade end portion 66, this space is closed by means of a peripheral wall 68 and an end plate 70 (see FIG. 1), said end plate being axially spaced from the end wall 6.

The collecting receptacle 34 at the discharge opening 36 will be gradually filled with emptied bags 33 which, unless special steps are taken, tend to be reintroduced into the casing 2 during rotation of the screw 4 in the reversing direction. The present invention provides a solution to this problem, by which reintroduction is avoided and the empty bags 33 supplied to the receptacle 34 are uniformly and circumferentially distributed.

This is achieved by means of a special design of the screw front end, and the appearance and mode of operation of this construction will now be described below, reference being had to FIGS. 3 and 5.

FIG. 3 which illustrates the exposed screw as seen obliquely from in front, clearly shows how the screw blade 14 at a point 72 axially spaced from the front end edge 74 of the centre tube 12 branches into an inner and an outer screw blade portion 76 and 78, respectively. The inner screw blade portion 76 is an extension of the rear feeding surface 14A of the screw blade 14 and extends circumferentially with essentially the same pitch as the screw blade 14 up to a radial end edge 80 axially spaced from the front end edge 74 of the centre tube 12 (FIG. 5). In the embodiment illustrated, the inner screw blade portion 76 describes an angle of approximately 270°.

The outer screw blade portion 78 forms an extension of the front feeding surface 14B of the screw blade 14 and extends circumferentially with a higher pitch than the screw blade 14 all the way up to the end edge 74 of the centre tube. In the embodiment illustrated, the outer screw blade portion 78 describes an angle of about 180°.

The outer screw blade portion 78, at a radial edge line 82 lying in the plane of the end plate 16, connects onto a third screw blade portion 84 having a negative pitch in relation to the screw blade 14 and the screw blade portions 76 and 78. The third screw blade portion has a circumferential length and a pitch such that it connects in a point onto the radial end edge 80 of the inner screw blade portion 76, as will appear from FIG. 5.

To avoid introduction of the emptied bags 33 into the space between the inner screw blade portion 76, the outer screw blade portion 78 and the third screw blade portion 84, the said space is closed by means of a peripheral wall 86.

The Table below provides an example of the pitch and circumferential length values of the different screw blade portions.

| | Pitch (mm) | Length (degrees) |
|---|---|---|
| Screw blade 14 | 200 | — |
| Inner screw blade portion 76 | 200 | 270 |
| Outer screw blade portion 78 | 600 | 180 |
| Third screw blade portion 84 | −600 | 90 |

With these values, the branching point 72 lies at an axial distance of 300 mm from the front end edge 74, and the radial end edge 80 lies at an axial distance of 150 mm from the end edge 74 and at an axial distance of 200 mm from the front feeding surface 14B of the screw blade 14. The last-mentioned axial distance of 200 mm between the end edge 80 and the front feeding surface 14B thus forms a bag discharge gap through which the emptied bags are discharged when the screw is rotated in the forward direction, whereupon the emptied bags are advanced the last 300 mm towards the receptacle 34 under the action of the outer screw blade portion 78.

The branching point 72 should not be too close to the bag discharge gap, as seen in the circumferential direction, because the gap may then be more readily clogged by emptied bags. On the other hand, the circumferential length of the outer screw blade portion 78 should not be too short since this may give a higher pitch, thereby detracting from the bag feeding function of the screw blade portion 78.

Regarding the front end of the screw 4, the negative pitch of the third screw blade portion 84 constitutes a specific feature of the invention, which serves to prevent reintroduction of such emptied bags as have already been discharged into the receptacle 34. The basic function of the third screw blade portion 84 is as follows.

When the screw 4 is rotated in the forward direction (the arrow F, FIG. 3) the third screw blade portion 84 is inactive and the edge 82 provides for a circumferential distribution of the bags 33 as last supplied. If, on the other hand, the screw 4 is rotated in the reversing direction (the arrow B, FIG. 3), the third screw blade portion 84 subjects the emptied bags 33 in the receptacle to discharging and compacting forces. By the rotation of the screw 4 in the reversing direction B, the emptied bags 33 nearest to the screw in the collecting receptacle 34 will, after they have been squeezed out by the screw blade portion 84, pass over the edge 82. As a consequence of their slow reexpansion following their compaction, there will be no time for these bags to reexpand to such an extent that, during the subsequent rotation of the screw through 270° in the reversing direction B, they can be reintroduced into the discharge gap between the edge 80 and the feeding surface 14B.

It therefore is important to restrict the compaction forces within the receptacle 34, which is achieved by the above-mentioned method of clamping the plastic bag 34 by means of the rubber ring 38 (FIG. 1). According as the plastic bag 34 is filled, it will move to the right in FIG. 1, in relation to the ring 38 and the flange 40, such that the compaction forces exerted on the emptied bags 33 within the receptacle 34 are maintained substantially constant.

Figure 5:
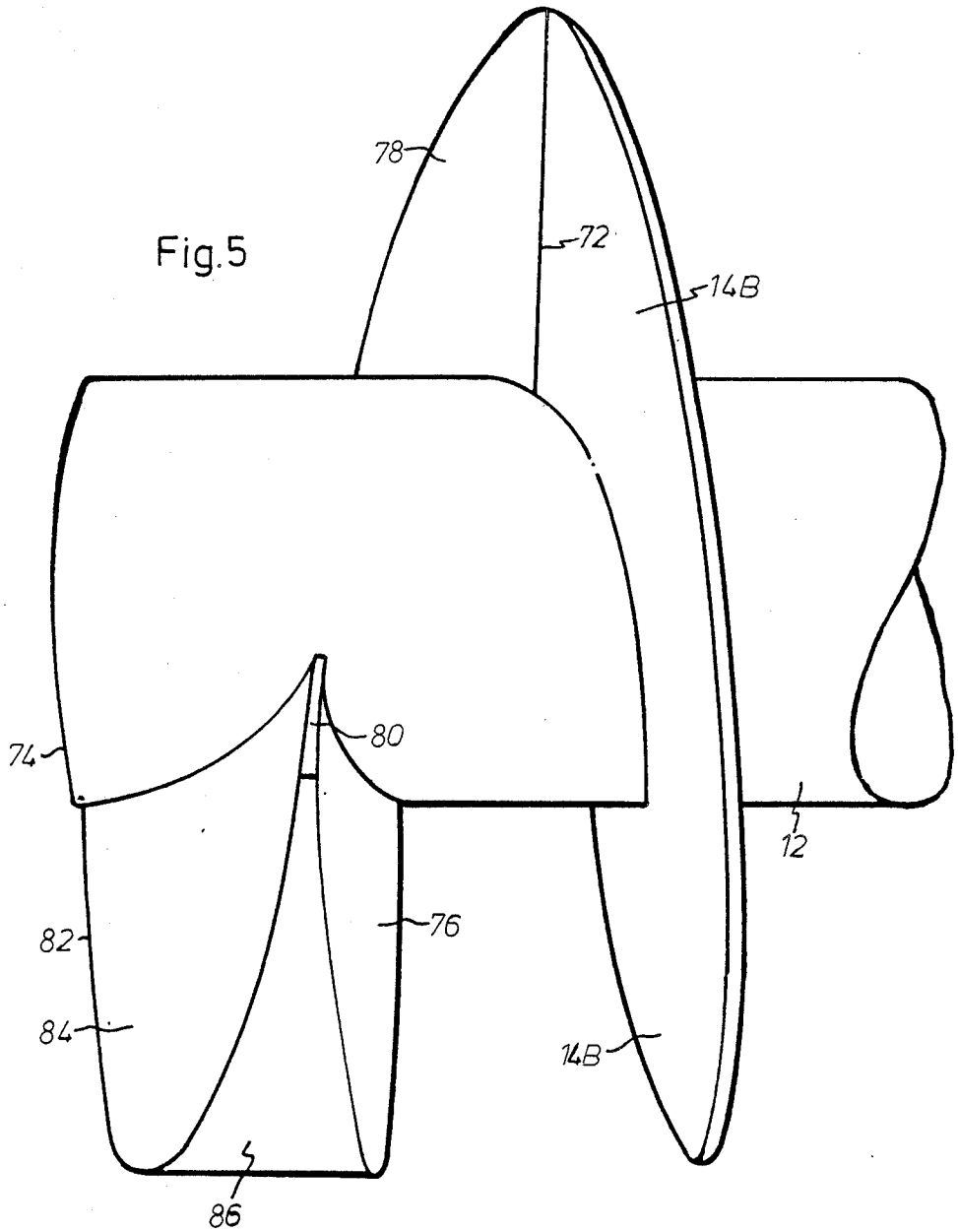
FIG. 5 is a lateral perspective view of a preferred embodiment of the screw front end, the screw rear end being broken away.

The construction shown at the front end of the screw 4 and described with reference to FIGS. 3 and 5 is a preferred, but not compulsory, feature of the invention. As an alternative, there may be provided instead, at the bag discharge opening 36 of the casing, a rubber plate having a star-shaped arrangement of slots through which the emptied bags are discharged and which prevents the undesired reintroduction.

Undesired reintroduction of bags can also be prevented if the bag discharge opening 36 instead is provided in the bottom of the casing 2, but in that case the emptied bags will not be compacted.

The above-described embodiment of the invention should thus be regarded merely as a preferred example of the invention and constitutes no restriction of the scope of protection which is defined exclusively by the appended claims.

For example, the bags may have been slightly cut by other cutting means before they are fed into the bag discharge opening 26, and furthermore the casing 2 and the screw 4 can be inclined relative to the horizontal plane; in one extreme case they may even be vertically directed. In the last-mentioned case, the end wall 6 may be perforated, such that the contents separated from the bags 54 can be removed through the end wall 6. In addition, the bag infeed opening 26 may be provided at the rear end of the screw 4, such that the bags are fed directly down at the position in the casing 2 where separation occurs, but in this case the screw will not cut the bags to any appreciable extent.

Also the specific construction of the screw rear end can be modified within the scope of the invention. The guide surface 64 need not be a rigid panel, but may just as well be in the form of a grid, a number of radially extending bars, or other means providing the desired separation effect.

Moreover, it will be appreciated that the casing 2 need not be in the form of a closed tube; it may also be in the form of an upwardly open U-shaped trough, one side of which may be inclined at an angle of, for example, 60° relative to the horizontal plane, whereby tumbling of the bags is achieved in that the bags instead of rotating around the screw, are moved up onto the inclined plane of the trough or casing 2 and there change their position relative to the screw.

Finally, it should be noted that the direction of rotation of the screw during the introduction and cutting of the bags is optional and not limited to the reversing direction.

I claim:

1. A method for emptying packages, especially bags, of their contents by means of a screw conveyor (2, 4) having a casing (2), an adjacent end wall (6) and a cutting and feeding screw (4) rotatable in the casing, the bags (54) being introduced via a peripheral opening (26) in the casing (2) into the screw (4) for cutting by rotation of said screw, the contents of the bags (54) being removed through perforations (28) in one of said casing (2) and the adjacent end wall (6), characterized by rotating said screw (4) in a first direction (B) for advancing cut bags (54) toward the end wall (6) adjacent a rear end (62) of said screw (4), the end wall (6) being connected onto said casing (2); tumbling the cut bags (54) at said end wall (6) about within said casing (2) by the screw rear end rotating in said first direction (B) to separate the contents from the cut bags; and rotating said screw (4), after completed separation at said screw rear end, in a second direction (F) opposite to said first direction (B), or advancing emptied bags (33) in a direction toward a front end of the screw (4) to a bag discharge opening (36) which is provided in said casing (2) and through which said emptied bags (33) are discharged from said screw conveyor (2, 4).

2. A method as claimed in claim 1, characterized in that said screw (4) is reversed repeatedly in connection with the separation at the screw rear end, before the emptied bags are advanced toward and discharged through said bag discharge opening (36).

3. A method as claimed in claim 1 or 2, in which said bag discharge opening (36) is an open axial end at the front end of said screw (4), and in which the emptied bags (33) discharged through said discharge opening

(36) are received by and compacted in a receptacle (34) associated with said discharge opening, characterized in that the forces required for compacting the emptied bags (33) are obtained by rotating the screw (4) and by discharge forces thus generated and acting on said emptied bags.

4. A method as claimed in claim 3, characterized in that there is provided at said discharge opening (36), an arrangement (76, 78, 84) preventing emptied bags (33) previously received by and compacted in said receptacle from being reintroduced into said casing (2) during rotation of said screw (4) in said first direction (B).

5. A method as claimed in claim 1 characterized in that a single bag at a time is introduced, cut, emptied and discharged.

6. An apparatus for emptying packages, especially bags, of their contents, said apparatus comprising a casing (2), an adjacent end all (6), a cutting and feeding screw (4) rotatably mounted within the casing (2) and consisting essentially of a shaft (12) and a screw blade (14) mounted thereon, said casing (2) having a peripheral opening (26) through which said bags are adapted to be introduced into said screw (4) for cutting by rotation of said screw, and one of said casing (2) and the end wall (6) having perforations (28) through which the bag contents are adapted to be removed characterized in that said casing (2) at a rear end of said screw (4) is closed by means of the end wall (6) connected onto the casing (2); that the appapratus further comprimises means (10, 2, 4) for rotating said screw in a first direction (B) for advancing cut bags (33) toward said end wall, the rear end of the rotating screw causing the cut bags (33) to tumble about within said casing (2) at the said end wall (6) for separating the contents from the cut bags; and said means for rotating rotates said screw (4) in a second direction (F) for advancing emptied bags (33) in a direction toward a front end of said screw (4) to a bag discharge opening (36) which is provided in said casing (2) and through which emptied bags (33) leave said casing (2).

7. An apparatus as claimed in claim 6, characterized in that a rear feeding surface (14A) of the screw blade (14), which surface faces the end wall (6), at a point (60) axially spaced from a rear end edge (62) of the shaft (12), passes over into a radially projecting, essentially planar guide surface (64) which, at its radially inner boundary line, connects onto a circumferential surface of the shaft (12) and extends up to the rear end edge (62) of the shaft (12) at a significantly smaller angle of inclination relative to an axial direction of the screw (4) than the screw blade (14) connected to the planar guide surface (64), the bags (54) cut by said screw being adapted to be moved, by rotation of said screw (4) in said first direction (B), into engagement with said guide surface (64) and to be tumbled about thereby within the casing (2) at the end wall (6) for separating the contents from the cut bags (54).

8. An apparatus as claimed in claim 7, characterized in that the screw blade (14) is extended in a circumferential direction, after a transition (60) to the said guide surface (64), by a screw blade end portion (66) extending up to the rear end edge (62) of said shaft( 12) and serving to advance emptied bags (54) in an axial direction away from said end wall (6) during rotation of said screw (4) in said second direction (F).

9. An apparatus as claimed in claim 8, characterized in that said screw blade end portion (66) over a major part thereof has a higher pitch than the associated screw blade (14).

10. An apparatus as claimed in any one of claims 6–9 in which said bag discharge opening (36) is an open axial end of the casing (2) at a front end (74) of the screw (4), and in which there is provided, in connection with said bag discharge opening (36), a collecting receptacle (34) within which the emptied bags (33) are adapted to be received and compacted, characterized in that the screw blade (14) at a point (72) on its last turn at the front end of the screw (4) is branched into an inner an an outer screw blade portion (76, 78), of which the inner screw blade portion (76) forms a direct extension of essentially unchanged pitch of a rear feeding surface (14A) of the screw blade (14) and opens in a radially directed end edge (80) axially spaced from a front en edge (74) of the shaft (12), and of which the outer screw blade portion (78) forms a direct extension of a front feeding surface (14B) of the screw blade (14) associated therewith and extends, at a higher pitch than the inner screw blade portion (76), from said branching point (72) to a front end edge (74) of the shaft (12), and that the screw (4) further has a third screw blade portion (84) of opposite or negative pitch extending from an end (82), positioned at the front end edge (74) of the shaft (12), of the screw blade portion (78) to the said radially directed end edge (80) of the inner screw blade portion (76).

11. An apparatus as claimed in claim 10, characterized in that the transition from the outer screw blade portion (78) to the third screw blade portion (84) forms an acute radial edge line (82) arranged to act upon emptied bags (33) introduced into a receptacle (34), such that the bags are uniformly distributed circumferentially within said receptacle (34) upon rotation (B or F) of said screw (4).

* * * * *